United States Patent [19]

Ross

[11] Patent Number: 4,461,656

[45] Date of Patent: Jul. 24, 1984

[54] LOW TEMPERATURE HARDENING OF THE SURFACE OF A FERROUS METAL WORKPIECE IN A FLUIDIZED BED FURNACE

[76] Inventor: John A. Ross, 188 Childs Rd., Basking Ridge, N.J. 07920

[21] Appl. No.: 475,490

[22] Filed: Mar. 15, 1983

[51] Int. Cl.[3] ..... C21D 1/48; C23C 9/14

[52] U.S. Cl. ..... 148/16.6; 148/16; 148/16.5; 148/20.3

[58] Field of Search ..... 148/16.6, 16, 16.5, 148/20.3

[56] References Cited

U.S. PATENT DOCUMENTS

| | | | |
|---|---|---|---|
| 1,748,378 | 2/1930 | Armstrong | 148/16.6 |
| 1,975,064 | 9/1934 | Malcolm | 148/16.6 |
| 3,096,221 | 7/1963 | Tanaka | 148/16.6 |

OTHER PUBLICATIONS

Japka, Joseph E., *Metal Progress,* 123, No. 2, pp. 27–33, Feb., 1983.

*Primary Examiner*—Veronica O'Keefe

*Attorney, Agent, or Firm*—Kenyon & Kenyon

[57] ABSTRACT

The surface of a ferrous metal workpiece is heat treated by immersing the workpiece to be treated in the fluidized particulate bed of a fluidized bed furnace. The bed is fluidized by a gas atmosphere comprising ammonia gas, hydrocarbon gas, and optionally a non-reactive gas. The temperature of the fluidized bed is maintained at about 600° F. to 1250° F. The proportion of the ammonia gas in the gaseous atmosphere may be varied to alter the surface characteristics of the treated workpiece. The compound layer and the underlying diffusion zone exhibit increased thicknesses. Increased hardness and increased impact loading resistance of the treated surface are obtainable.

17 Claims, 2 Drawing Figures

LOW TEMPERATURE HARDENING OF THE SURFACE OF A FERROUS METAL WORKPIECE IN A FLUIDIZED BED FURNACE

FIELD OF INVENTION

This invention relates to low temperature surface hardening treatments for ferrous metals. More particularly, this invention relates to low temperature surface hardening treatments for ferrous metal workpieces in a fluidized bed furnace and the characteristics of the treated surface thereby obtained.

BACKGROUND OF THE INVENTION

Low temperature surface treatment of ferrous metals with nitrogen is well known in the art and is generally referred to as nitriding. In addition, the low temperature surface treatment of ferrous metals with nitrogen and carbon is also well known and is generally referred to as nitrocarburizing.

When a ferrous metal is exposed to raw ammonia at temperatures below 1300° F., the surface of the metal will absorb nascent nitrogen created from the dissociation of the raw ammonia at the metal surface. In addition, if a hydrocarbon gas is also present, the metal surface will absorb a small amount of carbon from the breakdown of the hydrocarbon. The amount of nitrogen that the metal surface will absorb is a function of the amount of raw ammonia which reacts directly at the surface. The nitrogen which the surface absorbs combines with the iron (and other alloying elements, if present) in the metal and forms iron-nitrogen compounds (and alloy-nitrogen compounds, if present). As more nitrogen is absorbed, the nitrogen will diffuse inward into the metal, creating a gradient of nitrogen content in the surface of the metal. The concentration of nitrogen throughout this gradient will dictate the structure of the iron-nitrogen compounds that are formed.

Conventional low temperature surface hardening is typically carried out at temperatures below 1090° F. in either molten salt baths or recirculating gas-type furnaces. The temperature of these processes is limited to below 1090° F. in molten salt baths due to the melting points and chemical stability of the salts. In addition, salt baths are limited to a particular chemistry and therefore, will only produce one type of nitrogen gradient in the metal surfaces exposed to the salt.

Gas-type equipment is limited to temperatures below 1090° F. due to the catalytic effect of the furnace heater tubes or retort walls on the dissociation of the raw ammonia. In order for the ammonia to produce the desired effect on the metal, it must break down at the metal surface. If it breaks down anywhere else in the furnace, it will not affect the metal to be treated. In conventional furnaces, either heater tubes or retort walls (depending on the type of furnace) run at a higher temperature than the furnace work zone. The ammonia will preferentially break down at the higher temperature areas in the furnace. If the furnace is below 1090° F., the typical atmosphere flow through rate of the furnace supplies sufficient ammonia to break down both on the metal to be treated and at the heater tubes or retort walls; however, at higher temperatures, since the atmosphere flow through rate remains constant, yet there is more ammonia breaking down in other areas of the furnace, the metal becomes "starved" for ammonia. The flow through rate in a conventional furnace cannot be readily varied because of the design of the furnace.

The furnace is designed for a specific flow rate plus or minus, e.g., 10%. If one goes below the design flow rate, too much oxygen will enter from the exterior and there is a danger that the furnace may explode. If one goes above the design flow rate, the doors, vents and seals may blow off. Since these processes are limited in temperature and flow rate, and due to the requirements for high volumes of raw ammonia (to insure that the metal is not "starved" for nitrogen), there is very little flexibility in atmosphere and structure composition of the treated metal. In addition, it is known that any flammable atmosphere below auto ignition temperatures presents a safety hazard in this type of equipment due to the natural leakage and therefore oxygen infiltration.

Fluidized bed furnaces are also known. A fluidized bed furnace basically comprises a retort filled with an inert, sand-like material (typically aluminum oxide) and a method for heating the retort. A gas is passed through a diffusion plate at the bottom of the retort which acts to evenly distribute the gas flow over the bottom of the bed of aluminum oxide. At a certain gas flow rate, the velocity of the gas stream exceeds the drag force exerted by the particles of aluminum oxide and causes them to float (or be suspended) in the gas stream. At this point, the particles are fluidized and will take on many properties of a liquid.

OBJECT OF THE INVENTION

It is an object of the present invention to provide an improved method for low temperature hardening of the surface of a ferrous metal workpiece.

It is another object of the present invention to provide a ferrous metal workpiece with a relatively deep, high hardness surface.

It is another object of the present invention to provide a ferrous metal workpiece with a hardened surface which exhibits high impact loading resistance.

It is yet another object of the present invention to provide an improved method for low temperature hardening of the surface of a ferrous metal wherein the surface will have improved wear characteristics.

It is still another object of the present invention to reduce the cycle time required in a nitrocarburizing surface hardening process.

It is a further object of the present invention to provide a nitorcarburizing surface hardening process which has the ability to densely load the the metal parts to be treated while still maintaining uniform surface penetration.

It is still a further object of the present invention to provide a nitrocarburizing surface hardening process which has the capability to alter the gaseous atmosphere composition in order to control the surface characteristics so as to optimize the resultant metal properties near the surface of a ferrous metal workpiece for a given service application.

It is yet a further object of the present invention to provide nitrocarburizing surface hardening process wherein the gaseous atmosphere composition may be controlled without the need for costly control and monitoring equipment.

These and other objects will become apparent in the following description and claims in conjunction with the drawings.

SUMMARY OF THE INVENTION

The present invention may be generally summarized as a nitrocarburizing method for heat treating the surface of a ferrous metal workpiece comprising:

providing a fluidized bed furnace having a bed of metallurgically non-reactive particulate material which is thermally conductive in a fluidized state;

disposing the ferrous metal workpiece to be treated in said bed of non-reactive particulate material;

heating said bed to a temperature of about 950° F. to 1250° F.;

fluidizing said heated bed of particulate material with a gas atmosphere wherein said gas atmosphere comprises a source of nascent nitrogen and carbon;

whereby said nitrogen and said carbon react with the surface of said ferrous metal workpiece to provide a compound layer and an underlying diffusion zone on the surface of said workpiece.

The preferred gas atmosphere for fluidizing the bed comprises ammonia and a hydrocarbon gas. Non-reactive gas such as nitrogen or argon may be added to the gas atmosphere. A suitable particulate material for the fluidized bed is a sand-like material such as aluminum oxide.

A ferrous metal workpiece treated by the method of the present invention is characterized by a compound layer and an underlying diffusion zone having an increased depth in comparison with that obtained by the prior art. A ferrous metal workpiece having a surface treated by the method of the present invention exhibits improved hardness and wear resistance qualities and improved impact loading resistance.

The present invention is also directed to a ferrous metal workpiece having a compound layer and underlying diffusion layer on the surface thereof manufactured by the heat treating method of the invention.

The nitrocarburizing heat treating process of the present invention also is characterized by reduced cycle times in comparison with prior art processes.

The present invention is characterized by providing great flexibility in selecting the gaseous atmosphere, cycle time, and heat treating temperature in order to obtain optimum results in a given service application.

BRIEF DESCRIPTION OF THE DRAWING

In the drawing forming part hereof.

DESCRIPTION OF THE PREFERRED EMBODIMENTS

In order to afford a more complete understanding of the present invention and an appreciation of its advantages, a description of the preferred embodiments is presented below.

Figure 1:
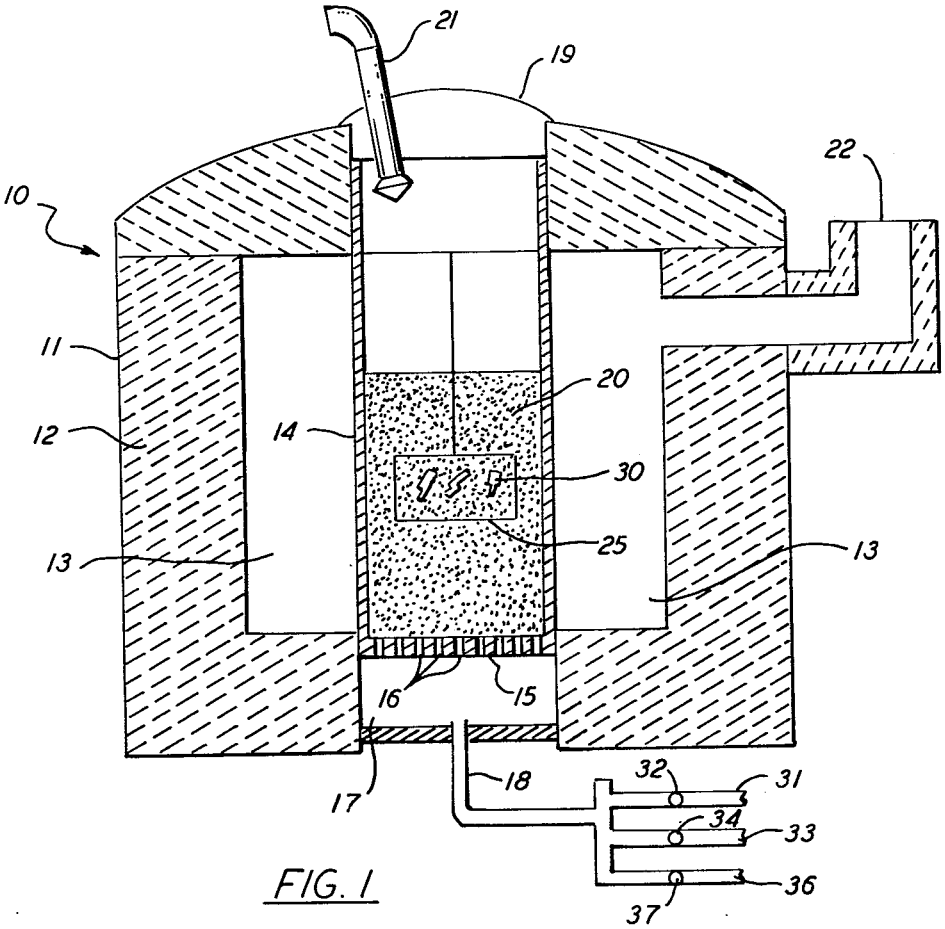
FIG. 1 is a schematic elevation view, partly in cross-section, of a fluidized bed furnace used in the practice of the present invention.

FIG. 1 schematically illustrates a conventional fluidized bed furnace 10. Such a furnace would comprise an outer shell 11 lined, for example, with a ceramic fiber material 12. A heating chamber 13 encloses a retort 14. The heating chamber 13 may be, for example, electrically heated or gas fired [not illustrated].

Mounted in the retort 14 is a diffusion plate 15 having a plurality of orifices 16 distributed over the extent of the diffusion plate. A plenum chamber 17 is positioned at the bottom of the retort 14 and is in fluid communication with the orifices 16 of the diffusion plate 15. A gas atmosphere inlet conduit 18 is in fluid communication with the plenum chamber 17.

A sand-like material 20, preferably aluminum oxide, is disposed over the diffusion plate 15 and fills a portion of the retort 14 above the diffusion plate 15. The retort 14 has a lid 19 provided with a venting conduit 21. The heating chamber 13 is provided with appropriate venting means 22 if the furnace is a gas fired unit. The lid 19 would be in place during operation of the furnace.

A basket-like member 25 containing workpieces 30 to be surfaced hardened is disposed within the retort 14. The workpieces 30 would be surrounded by the sand-like material 20 when the sand-like material becomes fluidized during the operation of the fluidized bed furnace 10. It will be appreciated that a larger variety of means may be provided for disposing workpieces to be surfaced hardened within the fluidized bed of the furnace.

As hereinbefore discussed, when gas is passed through the diffusion plate at a certain flow rate, the sand-like particles become fluidized by the gas stream. The gas flow rate required will, of course, depend on factors such as the cross-sectional area of the retort and the mesh size of the sand-like particles, e.g., the aluminum oxide used in the bed. Operation of a fluidized bed furnace is generally well known.

Those properties of a fluidized bed furnace which are most important to the heat treatment of metals, in accordance with the present invention, are the high rates of heat transfer and the high degree of thermal uniformity, both a result of the thermally conductive nature of fluidized solids. Another characteristic of fluidization which particularly influence theremochemical processes is the high velocity of gas necessary to fluidize the bed media. This results in a furnace volume versus atmosphere flow through rate typically in excess of, e.g., 300 volume turnovers per hour; conventional furnaces typically operate at 5 to 10 volume turnovers per hour.

Volume turnover may be briefly described as follows. The furnace work zone (or retort) has a volume Vf. Gas is supplied at a given rate R. Volume turnovers are therefore R/Vf. For fluidized beds, the sand takes up a volume Vs. Volume turnover is then: $R/(V_f - V_s)$.

It will be understood that 300 volume turnovers per hour is merely repesentative of volume turnovers achieved in a fluidized bed furnace. The importance of high volume turnovers per hour in conjunction with the present invention will be hereinafter discussed.

Another important aspect of fluidized bed furnaces, in accordance with the present invention, is that the flow through of gases is also very linearized. That is, the gases travel directly from the bottom of the retort to the top, with substantially no cross flow unless disrupted by the load of ferrous metal workpieces immersed in the fluidized bed. In this case, the gases will flow around and through the workpieces and then immediately restabilize into the lineal pattern. This acts to keep the retort substantially purged by the desired gases for fluidization with substantially no back infiltration of oxygen or other external atmospheric contaminents which always must be contended with when using conventional furnaces. The flow characteristics also act to keep the workpieces immersed in the fluidized bed constantly exposed to new, fresh atmosphere constituents. In addition, the flow characteristics will actually agitate the workpieces themselves which results in full exposure of the metal surfaces to the gases. Again, this is not possible in conventional furnaces due to the much lower gas velocities and circulation.

Figure 2:
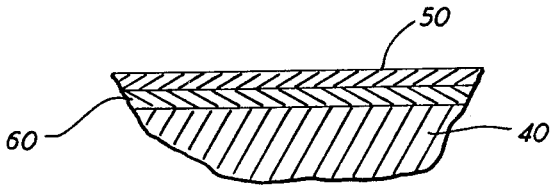
FIG 2 is an exaggerated fragment of a ferrous metal workpiece in sectional elevation which has been surfaced hardened by a nitrocarburizing process in accordance with the present invention and which schematically illustrates a compound layer overlying a diffusion zone layer.

With reference to FIG. 2, it is known that in nitriding and nitrocarburizing heat treating processes for the surface of a metal workpiece 40, that a compound layer 50 and an underlying diffusion zone layer 60 is formed on the surface of the workpiece.

The compound layer is a nitrogen-rich zone on the metal surface composed of iron nitrides (or carbonitrides if carbon is used in the atmosphere). Depending on the nitrogen content, these iron nitrides will take the form of epislon nitrides, gama prime nitrides or gamma nitrides. At nitrogen concentrations below 5.7% (by weight), the gamma nitrides are formed; at 5.7 to 6.1%, gamma-prime nitrides are formed; at 6.1 to 8.25%, a combination of gamma-prime and epsilon nitrides are formed; aboved 8.25%, only epsilon nitrides are formed. The higher the nitrogen concentration, the harder and more brittle the compound (i.e., epsilon nitrides are much harder than gamma nitrides). Conventional furnace processes typically produce epsilon nitrides in the compound layer, while the process of the invention can be adjusted to produce any single compound or combination of compounds. The addition of carbon to the surface will act to produce the corresponding epsilon, gamma-prime or gamma carbonitride which are slightly softer than the straight nitride. This will act to increase the ability of the metal surface to hold a lubricant and also slightly improves the corrosion properties of the surface. Epsilon nitrides or carbonitrides are desirable for abrasive wear while gamma-prime nitrides or carbonitrides are desirable for sliding wear and bending applications.

The diffusion zone has a much lower nitrogen concentration creating a gradient of nitrogen from the surface level to core level. If alloying elements are present in the metal, this zone will be comprised of alloy nitrides, while a plain carbon steel or cast iron will have a zone of iron precipitates (usually gamma and gamma-prime nitrides plus alpha iron). Carbon does not diffuse this far into the metal so does not effect the properties of this zone. The depth of this zone is more important than structure, as this zone is what will give the compound layer the ability to deform without cracking (such as with impact loading or bending).

At typical nitriding temperatures below 1090° F., it is known that a compound layer of about 0.0006 to 0.0008 inch is formed with an underlying diffusion zone of 0.010 to 0.025 inch, depending on cycle time. As this compound layer (which has the high hardnesses necessary for increased wear properties in the metal) is self-limiting in conventional processes at these temperatures, the only manner in which properties can be altered for a given service application, is through altering the concentration (and, therefore, type of compound) and depth of diffusion zone (which is solely a function of time).

The compound layer is self-limiting at temperatures below 1090° F. because once the surface nitrogen concentration equals the atmosphere nitrogen concentration, it will remain in equilibrium. At the same time, diffusion of nitrogen into the metal is occurring. For a given temperature, this diffusion rate will come into equilibrium with the rate at which the surface is being supplied (i.e., as an atom of nitrogen is added to the surface compound layer, an atom of nitrogen is being taken away by diffusion). Once this occurs, the surface compound layer will remain the same unless either the nitrogen concentration of the atmosphere (and therefore surface) is changed, or the temperature is changed. In conventional furnaces, both of these are limited (as described) and so, therefore, is the depth of the compound layer.

The ability to alter nitrogen concentration is an important aspect of the nitrocarburizing process in accordance with the present invention using a fluidized bed furnace. As hereinbefore discussed, molten salt bath processes are limited to a particular chemistry. Nitrogen concentration cannot be readily altered in a conventional furnace because a certain flow rate is required by the equipment design and a certain amount of ammonia is required to supply adequate nitrogen to the parts. The two requirements are typically about equal.

Although, altering nitrogen concentration is possible with ion or vacuum nitriding processes, such processes have the disadvantage of extremely expensive equipment and limitations on loading in that no part in the load can touch another part or fixture. Also, this equipment is currently limited in size and capacity so it is not suitable for high production work.

In accordance with the present invention, an ammonia and hydrocarbon gas atmosphere is passed through a fluidized bed 20 of a fluidized bed furnace 10 with a ferrous metal workpiece 30 to be surfaced hardened immersed in the fluidized bed. The temperature of the fluidized bed is advantageously maintained between about 950° F. and 1150° F. in many applications. In accordance with the present invention, an increase in depth of both the compound layer 50 and the underlying diffusion zone layer 60 is obtained in a heat treated workpiece. These increases in depth are obtained with significant reductions in cycle times.

The temperature should not be less than about 600° F. because below this, the solubility of nitrogen in iron is very limited. (A fluidized bed is the only equipment in which such a process can be done at this low of a temperature.) However, conventional equipment is limited to 975° F. as a lower limit due to the explosion hazards (or melting points in salt baths). Most fluid bed work is done at 950° F.–1150° F. because the higher the temperature, the faster the cycle for a given case depth. The only reason for going to a lower temperature would be if the core hardness requirements dictate a lower temperature. Cycle times for lower temperatures are generally longer.

The temperature should not be greater than about 1250° F. because a great portion of the raw ammonia will dissociate from the heat alone and will not provide nitrogen to the metal at higher temperatures, thereby reducing the flexibility to control nitrogen concentration and structure.

As hereinbefore discussed, the ammonia gas breaks down at the surface of the heated metal workpiece to provide nascent nitrogen for reacting with the surface of the workpiece. Other gases which would provide nascent nitrogen for reacting with the surface of the workpiece may be theoretically possible. Commercially available raw ammonia gas is the most suitable source of nascent nitrogen in accordance with the invention.

An advantageous hydrocarbon gas for use with the process of the invention is commercially available natural gas because of its ready availability. Examples of other suitable hydrocarbon gases are propane, acetylene, MAPP gas, ethylene, propylene and ethane. Use of other gaseous sources for carbon such as various alcohols may be possible but hydrocarbon gases are preferred. Alcohols may also be an oxygen source which may adversely react with the surface of the metal work piece in certain applications of the method of the invention. Any gas selected for use in the practice of the invention should not have characteristics or properties which would adversely affect the treated workpiece.

A non-reactive gas may be also mixed with the raw ammonia gas and the hydrocarbon gas to provide the gas atmosphere for fluidizing the fluidized bed. By non-reactive gas is meant a gas that will not react, in the practice of the process of the invention, so as to adversely affect the heat treating process or the metal workpiece being heat treated during the process. Examples of suitable non-reactive gases are nitrogen, argon and helium. Nitrogen gas is advantageous in most situations because of relative economy. It will be appreciated that nitrogen gas is highly stable and will not provide nascent nitrogen for reaction with the surface of the ferrous metal workpiece being treated.

Gas may be introduced into the fluidized bed by connecting a source of raw ammonia (not illustrated) to a conduit 31 having suitable regulating valve means 32. A source of hydrocarbon gas, such as natural gas (not illustrated) is connected to a conduit 33 having a suitable regulating valve means 34. The gas atmosphere is mixed and introduced into the fluidized bed through conduit 18 as hereinbefore discussed. Inert or non-reactive gas, such as nitrogen, may also be introduced and mixed in the gaseous atmosphere via a conduit 36 and suitable regulating valve means 37. If desired, the particulate material in the bed may be initially purged and fluidized by the non-reactive gas prior to the introduction of the reactive ammonia and hydrocarbon gas. This is typically done for all cycles as a safety precaution in order to remove all air from the furnace prior to admitting the flammable gases.

The particulate material in the bed to be fluidized is characterized by being metallurgically non-reactive and being thermally conductive in the fluidized state. By being metallurgically non-reactive is meant that the particulate material will not adversely affect the metal workpiece to be heat treated in the practice of the process of the present invention nor react adversely with the gas atmosphere. The size of the particulate material may be, e.g., about 150 mesh to 60 mesh (U.S. sieve series). A suitable particulate material is a sand-like material such as aluminum oxide.

It has been found, that in accordance with the present invention, the use of an atmosphere of 50% by volume raw ammonia plus 50% by volume natural gas at a temperature of 1100° F. to 1150° F. and a cycle time of 1½ hours will produce a compound layer 50 having a thickness of about 0.001 to 0.0025 inch and a diffusion zone 60 having a thickness of about 0.035 to 0.050 inch. The variations in thicknesses at these particular parameters reflect differences between various ferrous alloys. In general, the higher the alloy content, the faster and deeper is the case.

This increase in compound layer depth provides for a much higher surface hardness and, therefore, better wear and abrasion properties than those normally achieved in nitriding or nitrocarburizing type of processes. In addition, the increase in diffusion zone depth gives the hardened outer surface more support for impact-type loading.

The concentration of ammonia gas and hydrocarbon gas may be varied by increasing or decreasing the concentration of either of these gases and/or by the introduction of non-reactive gas into the atmosphere.

Increasing the concentration of ammonia gas and thereby increasing the amount of nascent nitrogen available for reaction with the metal workpiece will increase the hardness of the compound layer. Increasing the nitrogen content affects both the depth and structure of the compound layer but primarily the structure.

Decreasing the concentration of ammonia gas will result in a softer, more ductile compound layer which would be useful, for example, if sliding resistance was desired.

At these temperatures, the hydrocarbon gas has very little reactivity as well as the metal will only accept a certain small amount at these temperatures. The carbon which the metal does accept acts to give the surface lubricity which is useful for cutting tools, drills and sliding type applications. Going lower in concentration will not give you these properties, while going higher will result in sooting (which is deleterious in conventional furnaces). Fluid beds are often run with excess hydrocarbon, as soot does not effect them and natural gas is a cheaper diluent than nitrogen. It also has been found in fluid beds, that the hydrocarbon gives the ammonia slightly more activity as well as giving a more stable burn-off flame from the vent.

For providing a hard compound layer, useful gas atmospheres could contain about 30% to 100% by volume ammonia gas, about 0% to 70% hydrocarbon gas with the balance being non-reactive gas such as nitrogen and unavoidable impurities. Cycle times of about ½ hours to 2½ hours may be used. Cycle times of 1 hour to 1½ hours are typical in many applications. The thickness of the compound layer would range from about 0.001 inches to 0.003 inches. The hardness of the resulting surface would be about 68Rc to 72Rc. The thickness of the diffusion layer would be about 0.025 inches to 0.050 inches. The surface resulting may be characterized as file hard. File hard, as it is understood in the art, means that the surface has a hardness which cannot be cut with standard testing files of the 63Rc type. The present invention obtains a treated surface which is file hard because of the great depth of the compound layer which results.

For providing a ductile compound layer, useful gas atmospheres could contain 10% to 50% by volume ammonia gas, 10% to 75% hydrocarbon gas with the balance being non-reactive gas such as nitrogen and unavoidable impurities. Cycle times of about 178 hours to 2½ hours may be used. Cycle times of about 1 hour to 1½ hours are typical in many applications. The thickness of the compound layer would range from about 0.0006 inch to 0.0025 inch. The hardness of the resulting surface would be about 60Rc to 67Rc and about 63Rc to 67Rc being most typical. The thickness of the diffusion zone would be about 0.015 inches of 0.040 inches. Cycle time primarily dictates the depth of the case, particularly of the diffusion zone. There is little difference in its effect on hard vs. ductile compound layers, except that the ductile layer will be somewhat shallower than the hard layer for a given cycle time due to the lower nitrogen concentration.

The selection of a particular gaseous atmosphere, temperature and cycle time will generally depend on the particular type of ferrous metal to be treated and the surface results desired. The ability of the nitrogen to combine with the ferrous metal will vary with different ferrous metals. The present invention provides one skilled in the art a much broader range of selection than available in the known prior art.

In comparison, typical surfaces resulting from conventional furance or molten salt bath nitrocarburizing processes have compound layer thicknesses of about 0.0006 inches to 0.0008 inches; hardnesses of about 65Rc to 69Rc; diffusion zone thicknesses of about 0.010 inches to 0.025 inches. Cycle-times for conventional prior art processes are about 2½ hours to 3 hours. Surfaces from conventional prior art processes are not file hard.

The process of the present invention may be practiced at any temperature between 600° F. and 1250° F. In comparison, conventional prior art nitriding or nitrocarburizing is performed between 975° F. and 1090° F. The present invention may be practiced at a temperature greater than 1090° F. The advantage of being able to practice at temperatures greater than the prior art is that the higher the temperature, the faster the process. The increase in process speed is of commercial importance. The present invention may be practiced at temperatures of less than 975° F. The advantage of being able to practice at temperatures lower than the prior art is that in special applications, a selected core hardness may be desired in addition to the workpiece having good wear resistant properties. The desired selected core hardness may be lost if high temperatures must be used for surface treatment.

Practice of the process of the invention at less than 975° F., i.e., practice in the lower temperature ranges may be desirable for some tool steels. For low carbon/-low alloy, medium carbon/medium alloy, ductile or malleable irons, which have no appreciable core properties to lose, the process of the present invention would suitably be practiced at higher temperatures in order to speed the process.

Another advantage of the process in accordance with the present invention is that workpiece surface hardened by the process in accordance with the present invention may be bent to a much greater extent prior to exhibiting fracture at the surface than comparable workpieces surface hardened with prior art low temperature heat treating processes. This is believed to result from the increased thickness of the diffusion zone resulting from the process in accordance with the present invention.

Surfaces provided by the process of the present invention exhibit a characteristic referred to as impact loading resistance which is much improved over prior art processes. Impact loading resistance should not be confused with impact resistance which is a typical measurement of a strength of a material. Impact loading [of which impact loading resistance refers ] is the manner in which a load is applied to the surface. It is the type of loading that would be applied, e.g., to a stamp or a gear [as opposed to a sliding-type loading which would be applied, e.g, to a push button shaft]. There is no known or standard measurement for impact loading resistance other than the evaluation of how long a part lasts. [This is to be contrasted with impact resistance which is a common measurement.] The improved impact loading resistance achieved by the present invention is demonstrated by the examples which follow.

As hereinbefore discussed, the flow pattern of the atmosphere in fluidized bed furnaces is highly linearized. This minimizes contact and, therefore, reaction of the gases with the retort walls. Such highly linearized flow directs the atmosphere at the metal parts immersed in the fluidized bed. This enables this type of process to be performed at higher temperatures than in conventional furnaces.

In addition, the high velocity or flow-through of the atmosphere provides for rapid replenishment of the raw ammonia at the surface of the metal so the metal will not become "starved" for nitrogen. This allows for a flexibility in ammonia concentration and resultant nitrogen concentration in the metal, an ability only previously found in ion or vacuum nitriding. However, unlike fluidized beds, ion or vacuum nitriding is limited in temperature and in the loading configuration of the metal parts. As discussed in the foregoing, the high velocity of the atmosphere also acts to keep the parts immersed in the fluid bed separated even in a densely packed load. This allows for extremely even penetration of the nitrogen which cannot be done in any other type of equipment with the exception of certain types of salt baths.

The composition of the atmosphere (hydrocarbon-/ammonia/nitrogen) used for this process in fluidized beds is also unique. This type of atmosphere will not produce the desired effects in any other type of known equipment. Due to the type of reaction of a hydrocarbon at these temperatures, conventional equipment will produce free carbon or soot from the hydrocarbon which will coat the furnace interior and metal parts. The free carbon or soot prevents penetration of either carbon or nitrogen into the surface of metal being treated and is detrimental to the furnace components. Conventional equipment having such an atmosphere must therefore have an oxygen-bearing component added to prevent this sooting; however, the metal part being treated will also react with this oxygen, making this atmosphere unsuitable for certain types of oxygen-susceptible materials such as stainless steels, as well as lowering the degree of hardness obtainable in the compound zone for all types of metals. In general, an oxygen component is not desired in the process in accordance with the present invention. In fluidized bed furnaces, any free carbon produced by the hydrocarbon addition will preferentially coat the bed material and will not effect the retort or metal parts, other than to provide a small amount of carbon to the compound zone which is desirable for many metals.

Another advantage of the process of the present invention is that the gaseous atmosphere composition may be controlled without costly control and monitoring equipment. This is due to the thermal and atmosphere uniformity within the bed, the high purge rate which keeps contaminants out of the bed, and the stability of the atmosphere in the bed. Therefore, once an atmosphere is developed, one need only to repeat the flowmeter settings to duplicate the process. In conventional furnaces, natural leakage causes the atmosphere to change over a cycle, so the atmosphere must be monitored and controlled to counteract this.

The process in accordance with the present invention is generally usefully employed for hardening the surface of ferrous metal. The process of the present invention is particularly useful with low carbon—low alloy steels;

medium carbon—medium alloy steels; tool steels; cast or ductile irons and stainless steels. It has been found useful to treat ferrous metal parts, such as tool steels, by the process of the present invention wherein the parts have already been heat treated and tempered by conventional processes. Prior heat treating of most other alloy parts by conventional methods is not required by the present invention.

For certain applications, one skilled in the art may find practice of the present invention useful by only providing a source of nascent nitrogen. These would typically be applications where the prior art would have used a conventional nitriding process.

EXAMPLES

To assist in the understanding of the present invention, the following examples are set forth by way of illustration. It is understood that the examples are not intended to limit the scope of the invention as defined in the claims.

Example I

The nitrocarburizing method of the present invention was practiced in a fluidized bed furnace manufactured by Procedyne Corp., New Brunswick, N.J., Model Number HT-1850-2032. The diameter of the fluidized bed was 20 inches and had a depth of about 32 inches at a gas flow rate of about 900 to 1000 cu. ft. per hour. The particulate material was 80 mesh aluminum oxide. About 1000 pounds of the particulate aluminum oxide comprised the bed.

D-2 tool steel stamps were hardened and tempered by conventional processes. The fluidized bed was purged with 100% nitrogen gas [inert gas]. The stamps were then loaded into the bed.

The gaseous atmosphere, in accordance with the invention, passed through the fluidized bed was 50% by volume standard commercial anhydrous raw ammonia [provided by National Ammonia Co., Philadelphia, Pa.], and 50% by volume standard pipe-line natural gas [provided by Elizabeth Gas Co. of Elizabeth, N.J.]

The fluidized bed was heated and held at 975° F. The stamps were immersed in the fluidized bed having the described gaseous atmosphere for 1½ hours [cycle time]. The gaseous atmosphere was passed through the bed at a flow rate of about 1000 cubic feet per hour providing a turnover rate of about 300.

At the end of this period, the fluidizing gas was changed back to 100% nitrogen gas and the parts were held in the fluidized bed for an additional 30 minutes. The parts were then removed from the furnace and cooled.

The surface of the treated parts had the following characteristics:

compound layer thickness—0.0015 inches
diffusion zone thickness—0.025 inches
hardness—70Rc The stamps treated by the process of the present invention had a life of about 500,000 stampings. This compares with a life of about 40,000 to 50,000 stampings for stamps only treated with conventional hardening and tempering processes.

Example II

The method of the present invention was practiced as in Example I on high speed cutting tools fabricated from M-2 grade steel. The cutting tools had first been hardened and tempered by a conventional process.

The gaseous atmosphere, in accordance with the present invention, was 50% by volume raw ammonia and 50% by volume natural gas. The fluidized bed was held at a temperature of 1050° F. and the cutting tools were immersed in the bed having the described gaseous atmosphere for 25 minutes. The gaseous atmosphere was passed through the bed at a flow rate of about 1000 cubic feet per hour providing a turnover rate of about 300.

At the end of this period, the gaseous atmosphere was changed back to 100% nitrogen gas and the parts were held in the fluidized bed for an additional 25 minutes before removal from the furnace for cooling.

The surface of the treated parts had the following characteristics:

compound layer thickness—0.001 inches
diffusion zone thickness—0.015 inches
hardness—68/69Rc The cutting tools treated by the process of the present invention had a wear life of about 32 hours before resharpening was required. Cutting tools treated in the conventional hardening and tempering manner had a wear life of about 8 hours before sharpening was required.

Example III

The method of the present invention was practiced as in Example I on stapler parts fabricated from 1010 grade steel. The stapler parts fabricated from 1010 grade steel were previously carbonitrided for thirty minutes at 1500° F. in a conventional salt bath process and quenched in oil. This resulted in a large amount of twisting and distortion.

The gaseous atmosphere, in accordance with the present invention, was 50% by volume raw ammonia and 50% by volume natural gas. The parts were immersed in the fluidized bed held at a temperature of 1125° F. for 1½ hours. The flow rate was 1000 cubic feet per hour.

The surface of the treated parts had the following characteristics:

compound layer thickness—0.0025 inches
diffusion zone thickness—0.040 inches
hardness—71/72Rc The stapler parts treated by the method of the present invention did not twist or distort but still had the characteristics of wear resistance and hardness. The stapler parts treated by the method of the present invention had not been previously treated by the salt bath process and quenching.

Example IV

Slitter blades fabricated from 1050 grade steel are used for cutting cardboard jigsaw puzzles. Slitter blades have both severe wear problems plus a bending requirement for use. Prior to the present invention, there was no acceptable heat treatment available that would satisfy both these requirements.

The method of the present invention was practiced on slitter blades fabricated from 1050 grade steel.

The gaseous atmosphere, in accordance with the invention, was 57% by volume raw ammonia and 43% by volume natural gas. The parts were immersed in the fluidized bed held at a temperature of 1100° F. for 1½ hours. The flow rate was 1000 cubic feet per hour.

The surface of the treated parts had the following characteristics:

compound layer thickness—0.0025 inches diffusion zone thickness—0.040 inches
hardness—71/72Rc The slitter blades treated by the method of the present invention had a life of about 2 weeks as compared to a 1 week life for an untreated blade and an increase to about 1,000,000 cuts as compared to 500,000 cuts for an untreated blade.

The blades were substantially as ductile after treatment by the process of the invention as they were before treatment. They could be bent as easily as before. It is believed that the blades retained their ductility because the method of the present invention did not alter core properties. However, the slitter blades now had a harder surface so they wore better.

Although preferred embodiments of the present invention have been described in detail, it is contemplated that modifications may be made by those skilled in the art within the spirit and the scope of the present invention.

What is claimed is:

1. A method for treating the surface of a ferrous metal workpiece comprising:

providing a fluidized bed furnace having a bed of metallurgically non-reactive particulate material which is thermally conductive in a fluidized state;

heating said bed to a temperature of about 600° F. to 1250° F.;

fluidizing said heated bed of particulate material with a gas atmosphere consisting essentially of a source of nascent nitrogen and a source of carbon with the remainder of said atmosphere being non-reactive gas and unavoidable impurities;

disposing said ferrous metal workpiece to be treated in said heated fluidized bed;

whereby said nitrogen and carbon react with the surface of said ferrous metal workpiece disposed in said heated fluidized bed to provide a compound layer and an underlying diffusion zone on the surface of said workpiece.

2. A method as recited in claim 1 wherein said gas atmosphere consists essentially of a hydrocarbon gas and ammonia gas and unavoidable impurities.

3. A method as recited in claim 1 wherein said gas atmosphere consists essentially of a hydrocarbon gas, ammonia, non-reactive gas and unavoidable impurities.

4. A method as recited in claim 3 wherein said non-reactive gas is selected from the group consisting of nitrogen, argon and helium.

5. A method as recited in claim 4 wherein said non-reactive gas is nitrogen.

6. A method as recited in claim 1 wherein said workpiece is disposed in said heated bed fluidized by said gas atmosphere for about 0.5 hours to 2.5 hours.

7. A method as recited in claim 1 wherein said particulate material is aluminum oxide.

8. A method as recited in claim 1 wherein said gas atmosphere consists essentially of about 30% to 100% by volume ammonia gas and about 0% to 70% by volume hydrocarbon gas with the remainder being non-reactive gas and unavoidable impurities.

9. A method as recited in claim 8 wherein said compound layer has a thickness of about 0.001 to 0.003 inch and said diffusion zone layer has a thickness of about 0.025 to 0.050 inch.

10. A method as recited in claim 9 wherein said compound layer is characterized by file hardness.

11. A method as recited in claim 1 wherein said gas atmosphere consists essentially of about 10% to 50% by volume ammonia gas and about 10% to 75% by volume hydrocarbon gas with the remainder being non-reactive gas and unavoidable impurities.

12. A method as recited in claim 8 wherein said workpiece surface has an improved impact loading resistance.

13. A method as recited in claim 1 wherein said temperature is about 950° F. to 1150° F.

14. A method as recited in claim 8 wherein the hardness of said compound layer is at least about 68Rc.

15. A method as recited in claim 11 wherein the hardness of said compound layer is about 60Rc to 67Rc.

16. A method as recited in claim 9 wherein said workpiece is disposed in said heated bed fluidized by said gas atmosphere for about 0.5 hours to 2.5 hours.

17. A method as recited in claim 11 wherein said workpiece is disposed in said heated bed fluidized by said gas atmosphere for about 0.5 to 2.5 hours.

* * * * *